US007770429B2

(12) United States Patent
Viegner, Jr. et al.

(10) Patent No.: US 7,770,429 B2
(45) Date of Patent: Aug. 10, 2010

(54) METHOD FOR PRODUCING A COUPLING ON A PIPE AND DEVICE FOR PRODUCING SAID COUPLING

(75) Inventors: Walter Viegner, Jr., Attendorn (DE); Walter Bauer, Simmozheim (DE)

(73) Assignee: Witzig & Frank GmbH, Offenburg (DE)

( * ) Notice: Subject to any disclaimer, the term of this patent is extended or adjusted under 35 U.S.C. 154(b) by 686 days.

(21) Appl. No.: 10/580,859

(22) PCT Filed: Sep. 22, 2004

(86) PCT No.: PCT/EP2004/010591

§ 371 (c)(1),
(2), (4) Date: Mar. 1, 2007

(87) PCT Pub. No.: WO2005/061148

PCT Pub. Date: Jul. 7, 2005

(65) Prior Publication Data

US 2007/0256467 A1 Nov. 8, 2007

(30) Foreign Application Priority Data

Nov. 28, 2003 (DE) ..... 103 56 317

(51) Int. Cl.
*B21D 39/08* (2006.01)

(52) U.S. Cl. ..... 72/370.06; 72/370.03; 72/370.1; 72/393

(58) Field of Classification Search ..... 72/370.03, 72/370.08, 370.1, 368, 352, 393, 370.01, 72/370.06, 370.14, 370.15; 29/890.149; 285/114

See application file for complete search history.

(56) References Cited

U.S. PATENT DOCUMENTS 4,295,357 A * 10/1981 Roper ..... 72/344

(Continued)

FOREIGN PATENT DOCUMENTS

DE 100 64 376 A1 6/2002

(Continued)

OTHER PUBLICATIONS

International Search Report dated Dec. 21, 2004; including an English Translation of pertinent portions. (Sixteen (16) pages).

*Primary Examiner*—Dana Ross
*Assistant Examiner*—Stephanie Jennings
(74) *Attorney, Agent, or Firm*—Crowell & Moring, LLP

(57) ABSTRACT

In a method for producing a coupling on a pipe, preferably consisting of copper or steel or Cu—, Ni—, Fe— alloys, by way of a preferably graduated or one-stage expansion of the pipe end to create a much larger difference in diameter, an expansion tool is introduced axially into the end of the pipe. Once the expansion tool has been introduced into the pipe end, the region of the pipe end that is to be or has been expanded is completely or partially compressed, by a force acting axially on the pipe end, so that the external diameter of the pipe end that is to be processed is delimited by one or more shaping jaws that completely or partially surround the pipe end. The invention also relates to a device for producing a coupling on a pipe end according to the method.

12 Claims, 2 Drawing Sheets

U.S. PATENT DOCUMENTS

| | | | | |
|---|---|---|---|---|
| 4,768,369 | A * | 9/1988 | Johnson et al. | 72/368 |
| 4,845,972 | A * | 7/1989 | Takeuchi et al. | 72/370.03 |
| 5,615,481 | A * | 4/1997 | Viegener et al. | 29/890.149 |
| 6,718,811 | B2 * | 4/2004 | Drillon et al. | 72/208 |
| 6,843,096 | B2 * | 1/2005 | Viegener et al. | 72/370.03 |
| 2003/0127774 | A1 * | 7/2003 | Stephenson et al. | 264/320 |
| 2004/0003645 | A1 | 1/2004 | Viegener et al. | |
| 2004/0144152 | A1 * | 7/2004 | Wu | 72/370.06 |

FOREIGN PATENT DOCUMENTS

| | | |
|---|---|---|
| FR | 2 129 921 | 11/1972 |
| JP | 54 9152 | 1/1979 |
| WO | WO 02/02255 A1 | 1/2002 |

* cited by examiner

METHOD FOR PRODUCING A COUPLING ON A PIPE AND DEVICE FOR PRODUCING SAID COUPLING

BACKGROUND AND SUMMARY OF THE INVENTION

This invention relates to a method of making a socket on a pipe, preferably of copper or steel or alloys of Cu, Ni and Fe, by means of a preferably multi-step or single-step expansion of the pipe end with a large jump in diameter. For effecting the expansion, the pipe end is introduced axially into an expansion tool. The invention further relates to an apparatus for making a socket of such a type.

In the manufacture of copper or steel fittings from pipes, the sockets at the pipe ends are made preferably by a stepped expansion of the pipe portion. In each required step the wall thickness is reduced during expansion of the pipe. It has been found, for example, that in case of a pipe having a nominal width >50 mm and a wall thickness of 2.7 mm, after a two-step expansion the wall thickness is only 2.4 mm. In the last step of the expansion where the thinnest wall thickness occurs, the pipe end is, as a rule, inwardly flanged to ensure that during a subsequent joining of pipes, behind the flange a sufficient support for the sealing elements is obtained. Then later, the fitting is exposed to the greatest stress at the location of the flange and in the region of the sealing elements; this, in the worst case, may lead to leakages. Such leakages may occur if, because of the thin wall thickness, the socket is bent out at the location "A" indicated in the attached FIG. 1. In the conventional manufacturing methods, leakages as a result of an outward bending could be prevented only by initially choosing a greater wall thickness for the pipe. Thus, for the normal non-expanded portions, the pipe had to be over-dimensioned to a certain extent to ensure that the pipe withstands the required loads in the expanded portion which has the smaller wall thickness due to the expansion.

It is therefore the object of the invention to provide a method of and an apparatus for making a socket on a pipe, while an increase in the wall thickness of the utilized pipes may be dispensed with.

The object is achieved according to the claimed invention, and meaningful complementing method steps and additional embodiments of the apparatus are claimed as well.

To avoid the discussed problems encountered in the method according to the prior art, the solution according to the invention provides, particularly together with the last expansion step, or in a separate working step, for an upsetting step at the pipe end, while predetermining the inner diameter with the expansion tool. The outer diameter is limited by the upsetting device and the outer shaping shoe which surrounds the pipe end during expansion.

The method according to the invention makes possible, particularly in case of pipes made of copper or alloys of Cu, Ni and Fe, to achieve an increase of the wall thickness at locations where its resistance to forces is needed for subsequent use. The increase of the wall thickness inherently depends from the stroke "X" shown in FIG. 2.

It has been found particularly advantageous to bring the wall thickness in the critical region to the same thickness as that of the initial material of the pipe. By virtue of such a feature of the invention, the wall thickness of the initial pipe portion may be less by the amount by which the wall thickness can be increased as a result of the upsetting step. In this manner significant expenses in material may be saved. In the apparatus according to the invention for making a socket on a pipe end with the described method, an expansion tool is axially introducible into the pipe end and has one or more conical and cylindrical parts determining the subsequent inner diameter of the pipe end. One or more shaping shoes having conical and cylindrical parts determine the subsequent outer diameter of the pipe end, and a substantially cylindrically structured upsetting device has a smallest inner diameter which corresponds, with the necessary play, to the maximum outer diameter of the expansion tool. The device has a substantially radially extending annular shoulder that may be pressed axially against the end face of the pipe end during the upsetting step.

Thus, by virtue of cooperation between the expansion tool, the shaping shoe and the upsetting device, a pipe socket of preferably multi-step enlargement may be formed. The upsetting device in essence comprises a cylindrical tube which has an inner annular recess for receiving the expanded pipe end and which is pressed axially against the end face of the pipe end. The inner diameters of the recess and the shaping shoe are provided preferably in the region in which an increase of the wall thickness needs to be effected and are coordinated with one another in such a manner that the desired wall thickness may be obtained dependent from the intended stroke, that is, dependent from a relative displacement between the upsetting device and the shaping shoe.

The invention will be described in an exemplary manner in more detail with reference to FIGS. 1 and 2.

DETAILED DESCRIPTION OF THE INVENTION

Figure 1:
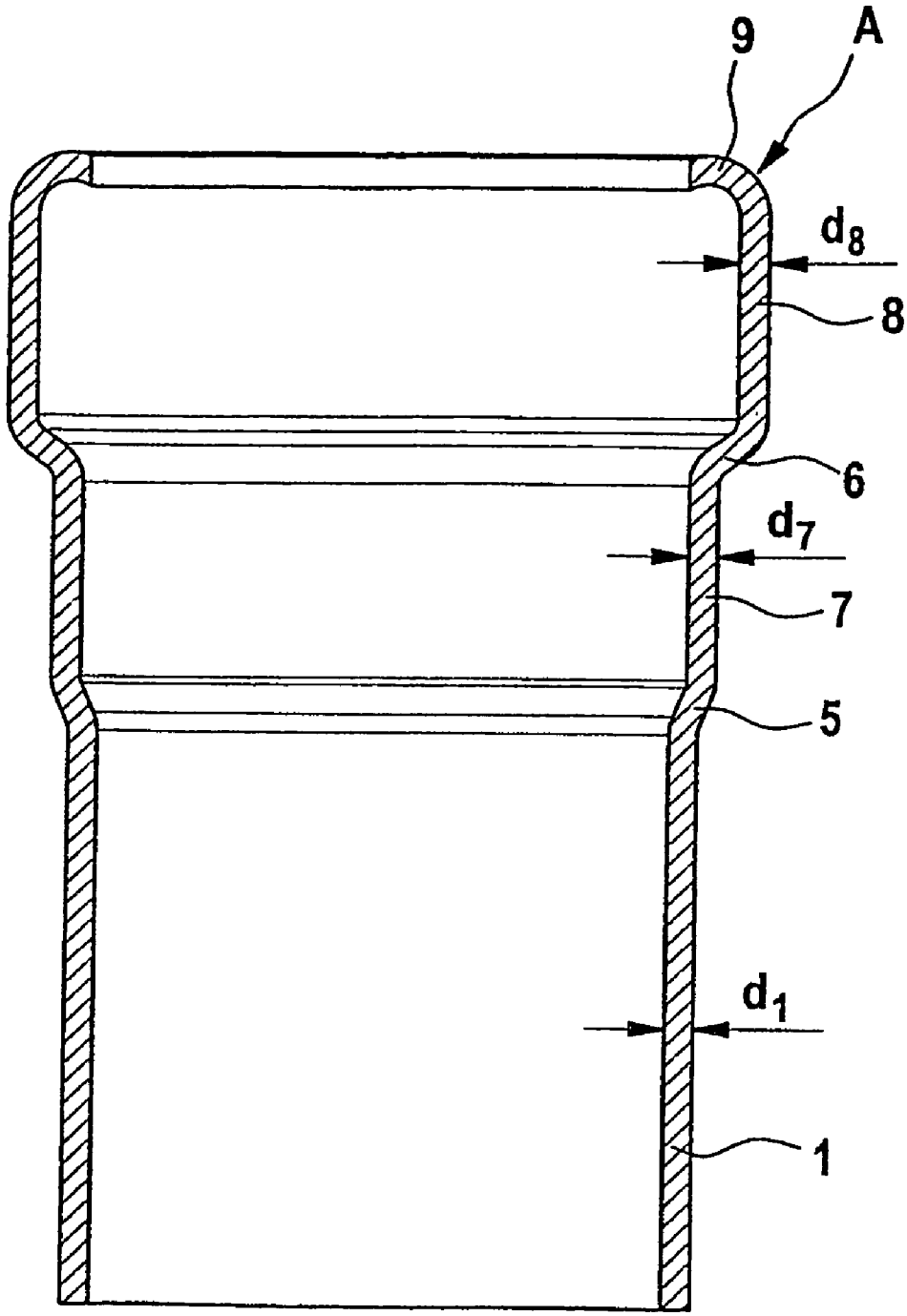
FIG. 1 is a sectional view of a configuration of a socket on a tube 1, made according to the invention.

The finished pipe 1 shown in FIG. 1 has a wall thickness d1 which corresponds to the wall thickness of the original pipe material. Following a two-step expansion, the pipe has a first conical part 5, an adjoining first cylindrical part 7 having a wall thickness d7 which is reduced with respect to the wall thickness d1 in accordance with the extent of the expansion, a second conical part 6, an adjoining second cylindrical part 8 and an inwardly bent flange 9. The second cylindrical part 8 has a wall thickness d8 which, prior to providing the flange 9, was increased to the required extent by means of the upsetting step according to the invention. The wall thickness d8 should at least equal the wall thickness d7. It has even been found advantageous to bring the wall thickness up to the wall thickness d1.

Figure 2:
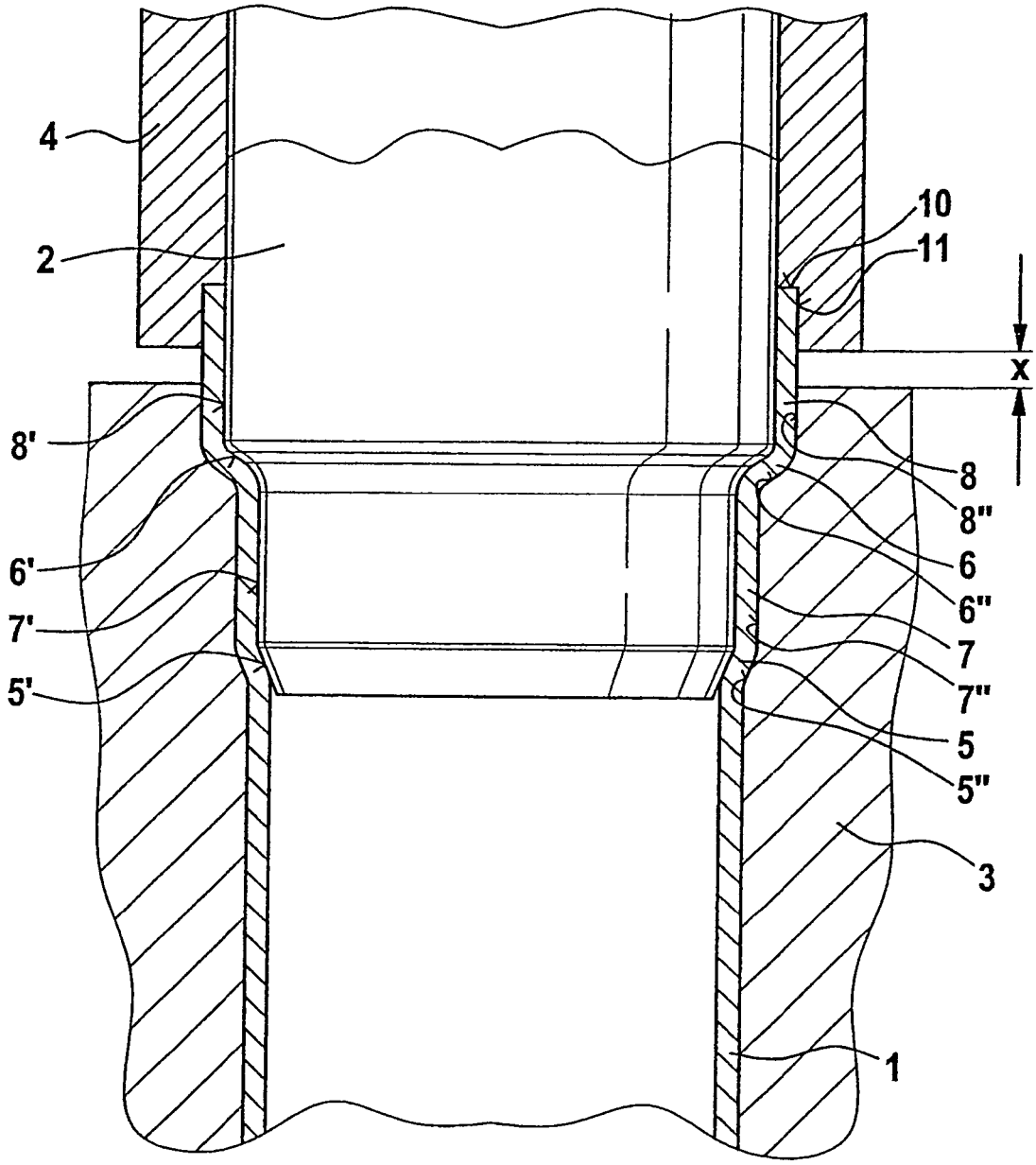
FIG. 2 is a sectional view of the essential parts of the apparatus according to the invention during the steps of expanding and upsetting the tube end.

In FIG. 2 the multi-step expansion tool 2 has already been axially pressed into the pipe end. The shape of the socket having parts 5 to 8 is formed on the inside by the parts 5' to 8' of the expansion tool 2 and is formed on the outside by parts 5" to 8" of the shaping shoe 3. For providing the greater wall thickness of the cylindrical part 8, the upsetting device 4, formed essentially of a cylindrical tube, is pressed with the inner shoulders 10 axially against the pipe end, while the relative displacement between the shaping shoe 3 and the upsetting device 4 may have a maximum stroke X. The upsetting device 4 has an annular recess which is intended for receiving the part 8 of the pipe end and which is formed by the cylindrical part 11 and the shoulder 10. While according to the invention it may be sufficient to perform the required enlargement of the wall thickness by the upsetting step only in the zone of the axial length of the cylindrical part 11, it may nevertheless be advantageous to simultaneously also thicken that portion of the cylindrical part 8 which is surrounded by the shaping shoe 3.

The invention claimed is:

1. A method of making a socket on a pipe made of copper, steel or alloys of Cu, Ni and Fe, by an at least single-step expansion of a pipe end with a large jump in diameter, comprising:

introducing an expansion tool axially into the pipe end, and expanding a region of the pipe end to provide an expanded region of the pipe end with an enlarged wall thickness no earlier than introduction of the expansion tool into the pipe end by a force applied axially to the pipe end while limiting an outer diameter of the pipe end to be processed by way of an upsetting device and at least one shaping shoe at least partially surrounding the pipe end.

2. The method as defined in claim 1, wherein the pipe end has a multi-step expansion, and only the expanded region of the pipe end of largest diameter is upset.

3. The method as defined in claim 1, wherein the expanded or the expanded region of the pipe end is upset to such an extent that the wall thickness thereof is increased up to the wall thickness of the previously expanded portion.

4. The method as defined in claim 1, wherein the pipe end is inwardly flanged for receiving sealing elements.

5. The method as defined in claim 2, wherein the expanded or the expanded region of the pipe end is upset to such an extent that the wall thickness thereof is increased up to the wall thickness of the previously expanded portion.

6. The method as defined in claim 2, wherein the pipe end is inwardly flanged for receiving sealing elements.

7. The method as defined in claim 3, wherein the pipe end is inwardly flanged for receiving sealing elements.

8. An apparatus for making a socket on a pipe end having an expanded region with an enlarged wall thickness, comprising:

an expansion tool which is axially introducible into the pipe end and which has one or more conical and cylindrical parts adapted to determine a subsequent inner diameter of the pipe end, at least one shaping shoe having conical and cylindrical parts adapted to determine a subsequent outer diameter of the pipe end, and a substantially cylindrically structured upsetting device having a smallest inner diameter which corresponds, with necessary play, to a maximum outer diameter of the expansion tool and a substantially radially extending annular shoulder which is pressable axially against an end face of the pipe end during an upsetting step to produce said expanded region of said pipe end with said enlarged wall thickness.

9. The apparatus as defined in claim 8, wherein, on its side oriented toward the pipe end, the expansion tool has a cylindrical part which adjoins the shoulder, and at least one of the upsetting device and the shaping shoe has an inner diameter which determines the greatest diameter of that enlarged outer diameter of a cylindrical part of the pipe end which is reached after the upsetting step.

10. The apparatus as defined in claim 9, wherein the diameter of the cylindrical part of the expansion tool corresponds to a maximum inner diameter of the at least one shaping shoe.

11. The apparatus as defined in claim 9, wherein an axial length of the expansion tool cylindrical part is no less than a length of a cylindrical part of said shaping shoe.

12. The apparatus as defined in claim 10, wherein an axial length of the expansion tool cylindrical part is no less than a length of a cylindrical part of said shaping shoe.

* * * * *